US008471664B1

(12) United States Patent
Huang et al.

(10) Patent No.: US 8,471,664 B1
(45) Date of Patent: Jun. 25, 2013

(54) TRANSFORMER WITHOUT COIL RACKS

(75) Inventors: Yung-Hsin Huang, New Taipei (TW); Tzung-Han Lee, New Taipei (TW); Yun-Chen Chen, New Taipei (TW)

(73) Assignee: Zippy Technology Corp., New Taipei (TW)

( * ) Notice: Subject to any disclaimer, the term of this patent is extended or adjusted under 35 U.S.C. 154(b) by 0 days.

(21) Appl. No.: 13/454,805

(22) Filed: Apr. 24, 2012

(51) Int. Cl.
*H01F 27/30* (2006.01)
*H01F 27/28* (2006.01)

(52) U.S. Cl.
USPC ..... 336/185; 336/199; 336/206

(58) Field of Classification Search
USPC ..... 336/185, 199, 206, 208, 209, 221
See application file for complete search history.

(56) References Cited

U.S. PATENT DOCUMENTS

| | | | | |
|---|---|---|---|---|
| 3,581,249 | A * | 5/1971 | Spangler et al. | 333/185 |
| 4,494,095 | A * | 1/1985 | Noji et al. | 334/85 |
| 5,036,302 | A * | 7/1991 | Hales | 333/202 |
| 6,919,788 | B2 * | 7/2005 | Holdahl et al. | 336/83 |
| 7,076,230 | B2 * | 7/2006 | Nakatsuji et al. | 455/300 |
| 2010/0033284 | A1 * | 2/2010 | Yamakami et al. | 336/192 |
| 2010/0102914 | A1 * | 4/2010 | Ger et al. | 336/208 |

FOREIGN PATENT DOCUMENTS

| | | | |
|---|---|---|---|
| TW | I305654 | B | 1/2009 |
| TW | 200923985 | A | 6/2009 |

* cited by examiner

*Primary Examiner* — Mohamad Musleh
*Assistant Examiner* — Joselito Baisa
(74) *Attorney, Agent, or Firm* — Muncy, Geissler, Olds & Lowe, PLLC

(57) ABSTRACT

A transformer without coil racks includes a winding set, multiple conductive plates and an insulation mounting sheet. The winding set includes a coil portion and a magnetic core set running through the coil portion. The magnetic core set includes at least one inner magnetic core portion and at least two outer magnetic core portions that are spaced from each other by a gap. Each conductive plate includes a connecting section and two extended arms connected to two ends of the connecting section and running through the gap. The insulation mounting sheet includes multiple retaining slots corresponding to the gap to allow the extended arms to pass through and multiple retaining portions each being formed between two neighboring retaining slots to prevent the extended arms from contacting each other. The conductive plates run through the retaining slots and are confined by the retaining portions from moving.

5 Claims, 4 Drawing Sheets

TRANSFORMER WITHOUT COIL RACKS

FIELD OF THE INVENTION

The present invention relates to a transformer and particularly to a transformer without coil racks.

BACKGROUND OF THE INVENTION

City power used by people mostly has a voltage range between 110V and 220V. However, most electronic products require a voltage lower than the aforesaid range. Hence a transformer usually is needed to adjust the voltage of the power source supplied to the electronic products. A conventional transformer generally comprises a coil rack, an induction coil and a magnetic core coupled together. The induction coil usually is formed by winding a cylindrical metal wire in a helical shape and coated with a layer of insulation lacquer on the surface thereof. For instance, R.O.C. patent No. I305654 discloses a technique including a first coil to receive input signals, a second coil to transmit the signals input to the first coil, a first column wound by the first coil and a first magnetic core surrounding a first wall of the first column, and a second column wound by the second coil and a second magnetic core surrounding a second wall of the second column. The first magnetic core has relative permeability greater than that of the second magnetic core. The first column opposes and connects to the second column to allow the first wall also to oppose and connect to the second wall. The first coil or second coil generates a magnetic loop with magnetic flux to pass through the first column and second column.

R.O.C. publication No. 200923985 discloses a high voltage transformer with adjustable magnetic flux leakage. It comprises a winding rack unit, a primary coil, a first secondary coil and a magnetic core unit. The primary coil is wound on the winding rack unit. The first secondary coil also is wound on the winding rack unit. The magnetic core unit includes a first magnetic core running through the winding rack unit and a second magnetic core running through the winding rack unit to connect to the first magnetic core. The second magnetic core has a second base column, two first and second secondary side columns extended from two opposite ends of the second base column and extended towards the first magnetic core, and a magnetic regulation end extended from the second base column to the first magnetic core and located between the secondary side columns. The magnetic cores form a magnetic flux path connecting the first secondary coil and primary coil. By regulating the magnetic flux leakage via the magnetic regulation end, impedance match can be achieved.

All the aforesaid transformers have a coil rack for winding the coils. The coil rack is formed at a definite volume which cannot be shrunk as desired. Nowadays electronic products are more complex and the demand of slim and light is increasing. Requirement for shrinking transformer size also has been raised constantly. The existence of the coil rack hinders miniaturization possibility of the electronic products.

SUMMARY OF THE INVENTION

The primary object of the present invention is to solve the problem of the conventional transformer that contains a coil rack and cannot be shrunk into a smaller size.

To achieve the foregoing object, the invention provides a transformer without coil racks. It is mounted onto a circuit board and includes a winding set, a plurality of conductive plates and an insulation mounting sheet. The winding set includes a coil portion located above the circuit board and having a predetermined number of coils and a magnetic core set running through the coil portion. The coil portion has a conductive wire with two ends electrically connected with the circuit board and an insertion passage formed by winding of the conductive wire to allow the magnetic core set to pass through. The magnetic core set includes at least one inner magnetic core portion running through the insertion passage and at least two outer magnetic core portions located at two sides of the inner magnetic core portion. The inner magnetic core portion is spaced from the outer magnetic core portions by a gap. Each conductive plate includes at least a connecting section to cover the top side of the coil portion, two extended arms connected to two ends of the connecting section and running through the gap, and two connection pins extended from the extended arms to connect to the circuit board. The insulation mounting sheet is interposed between the connecting section and coil portion, and includes a plurality of retaining slots corresponding to the gap to allow the extended arms to pass through and a plurality of retaining portions each being formed between two neighboring retaining slots to prevent the extended arms from contacting each other to form conductive connection. The conductive plates run through the retaining slots and are confined by the retaining portions from moving.

In one aspect the magnetic core set includes a first magnetic core and a second magnetic core opposing the first magnetic core. The first magnetic core formed at a coaxial length to run through the insertion passage is smaller than that of the second magnetic core to run through the insertion passage.

In another aspect the first magnetic core and second magnetic core form an EE or EI combination.

In yet another aspect the invention further includes a reinforcing mounting sheet which is located between the coil portion and the circuit board and has a plurality of insertion slots corresponding to the retaining slots.

In yet another aspect the circuit board has a plurality of mounting slots corresponding to the connection pins.

The invention thus formed provides many advantages, notably:

The magnetic core set and coil portion are coupled together, and the conductive plates run through the insulation mounting sheet to straddle the coil portion and also run through the gap of the winding set to be mounted onto the circuit board, thus the retaining slots and retaining portions formed on the insulation mounting sheet can confine the conductive plates from moving so that they do not contact each other to generate short circuit. Thus the invention can be securely mounted onto the circuit board without coil racks as the conventional transformers do. As a result, the transformer of the invention can be shrunk to a smaller size to conform to the prevailing trend of miniaturization of modern electronic products.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
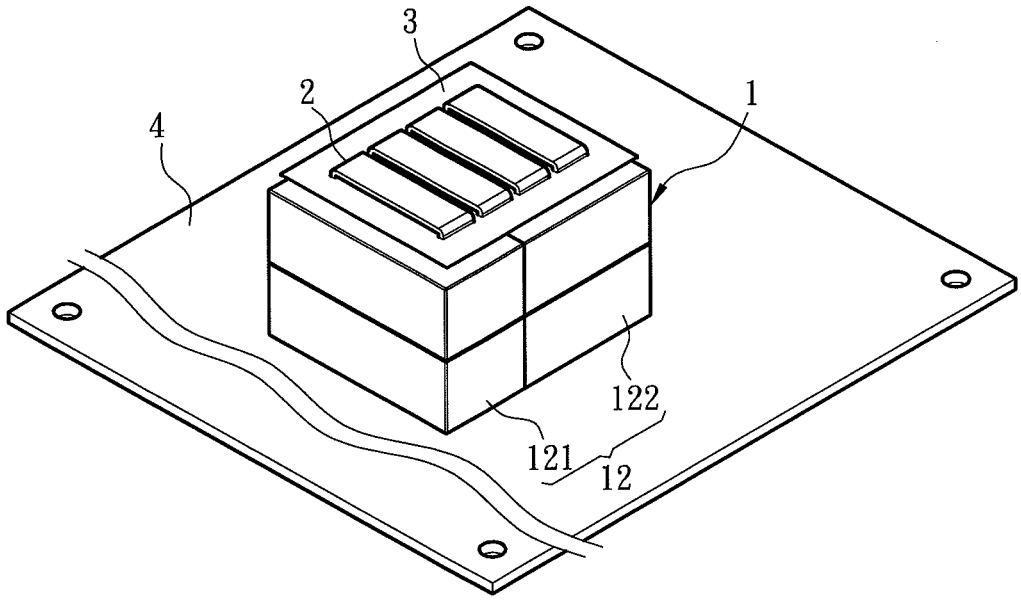
FIG. 1 is a perspective view of the transformer without coil racks according to the invention.
Figure 2:
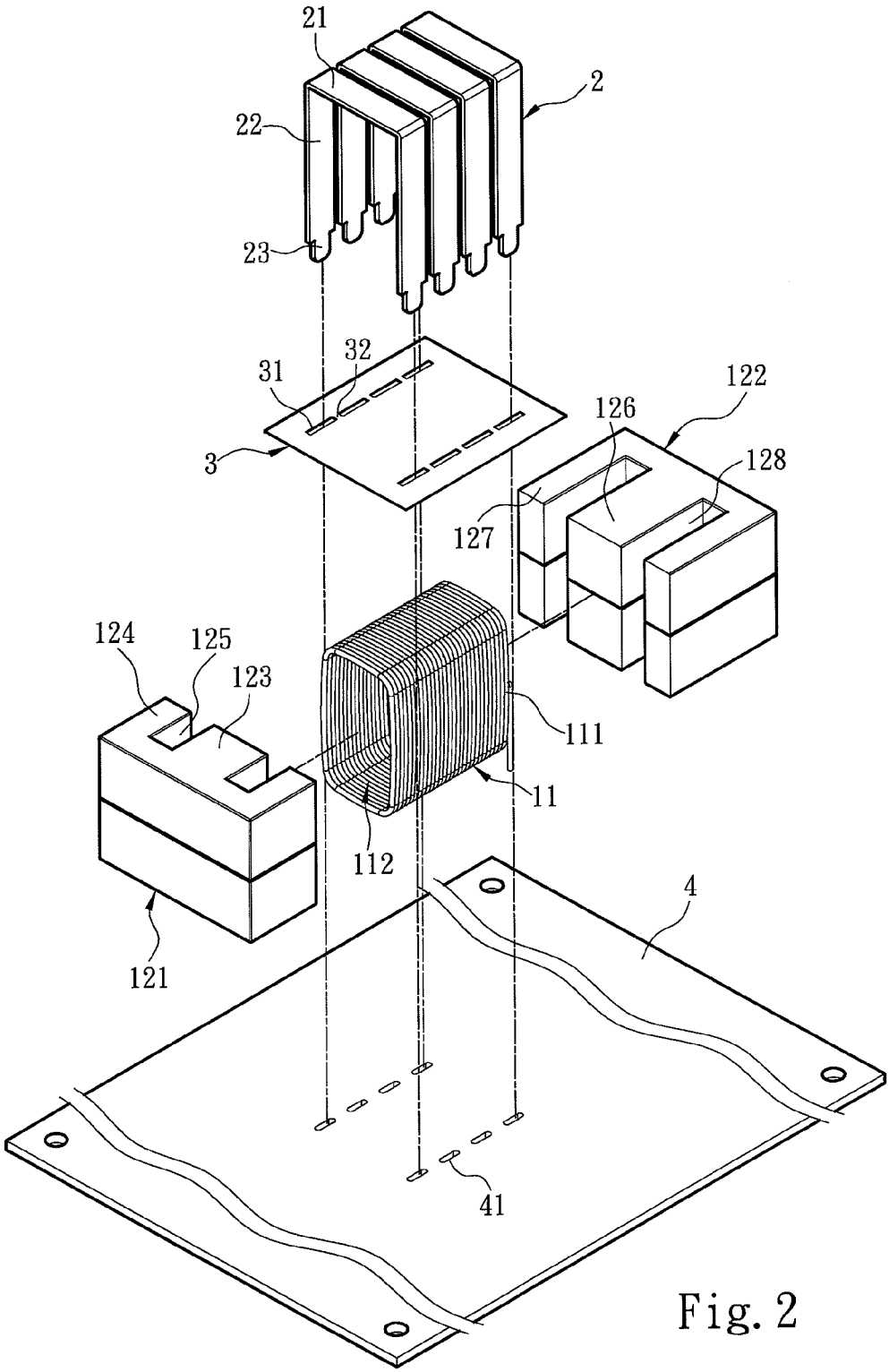
FIG. 2 is an exploded view of the transformer without coil racks according to the invention.

Please refer to FIGS. 1 and 2, the present invention aims to provide a transformer without coil racks. It is mounted onto a circuit board 4 and includes a winding set 1, a plurality of conductive plates 2 and an insulation mounting sheet 3. The winding set 1 includes a coil portion 11 located above the circuit board 4 and having a predetermined number of coils and a magnetic core set 12 running through the coil portion 11. The coil portion 11 has a conductive wire 111 with two ends electrically connected with the circuit board 4 and an insertion passage 112 formed by winding of the conductive wire 111 to allow the magnetic core set 12 to pass through. The magnetic core set 12 includes at least one inner magnetic core portion 123 or 126 running through the insertion passage 112 and at least two outer magnetic core portions 124 and 127 located at two sides of the inner magnetic core portion 123 or 126. The inner magnetic core portion 123 or 126 is spaced from the outer magnetic core portions 124 or 127 by a gap 125 or 128. Each conductive plate 2 includes at least a connecting section 21 to cover the top side of the coil portion 11, two extended arms 22 connected to two ends of the connecting section 21 and running through the gaps 125 and 128, and two connection pins 23 extended from the extended arms 22 to connect to the circuit board 4. The insulation mounting sheet 3 is interposed between the connecting section 21 and coil portion 11, and includes a plurality of retaining slots 31 corresponding to the gaps 125 and 128 to allow the extended arms 22 to pass through and a plurality of retaining portions 32 each being formed between two neighboring retaining slots 31 to confine the extended arms 22 from contacting each other to form conductive connection. The conductive plates 2 run through the retaining slots 31 and are confined by the retaining portions 32 from moving.

In an embodiment of the invention, the coil portion 11 has a conductive wire 111 with two ends electrically connected with the circuit board 4 and an insertion passage 112 formed by winding of the conductive wire 111 to allow the magnetic core set 12 to pass through. The conductive wire 111 has one end connecting to the circuit board 4 to serve as an input end and other end opposite to the input end and connecting to the circuit board 4 to serve as an output end, thereby form a loop.

Referring to FIG. 2, the magnetic core set 12 includes a first magnetic core 121 and a second magnetic core 122 opposing the first magnetic core 121. The first magnetic core 121 and second magnetic core 122 form an EE combination. The first magnetic core 121 has an inner magnetic core portion 123 and two outer magnetic core portions 124 at two sides of the inner magnetic core portion 123. The inner magnetic core portion 123 is spaced from the outer magnetic core portions 124 by a gap 125. The second magnetic core 122 also has an inner magnetic core portion 126 and two outer magnetic core portions 127 at two sides of the inner magnetic core portion 126, and the inner magnetic core portion 126 also is spaced from the outer magnetic core portions 127 by another gap 128. The first magnetic core 121 and second magnetic core 122 run through the insertion passage 112 to couple with the coil portion 11, and the inner magnetic core portion 123 of the first magnetic core 121 and the inner magnetic core portion 126 of the second magnetic core 122 oppose to each other, and the outer magnetic core portions 124 of the first magnetic core 121 and the outer magnetic core portions 127 of the second magnetic core 122 also oppose to each other, thereby the first magnetic core 121 and second magnetic core 122 form a magnetic loop. Moreover, the gaps 125 and 128 of the first and second magnetic cores 121 and 122 communicate with each other. In the invention, the first magnetic core 121 formed at a coaxial length to run through the insertion passage 112 is smaller than that of the second magnetic core 122 that are asymmetrical, but this is not the limitation of the invention.

Figure 3:
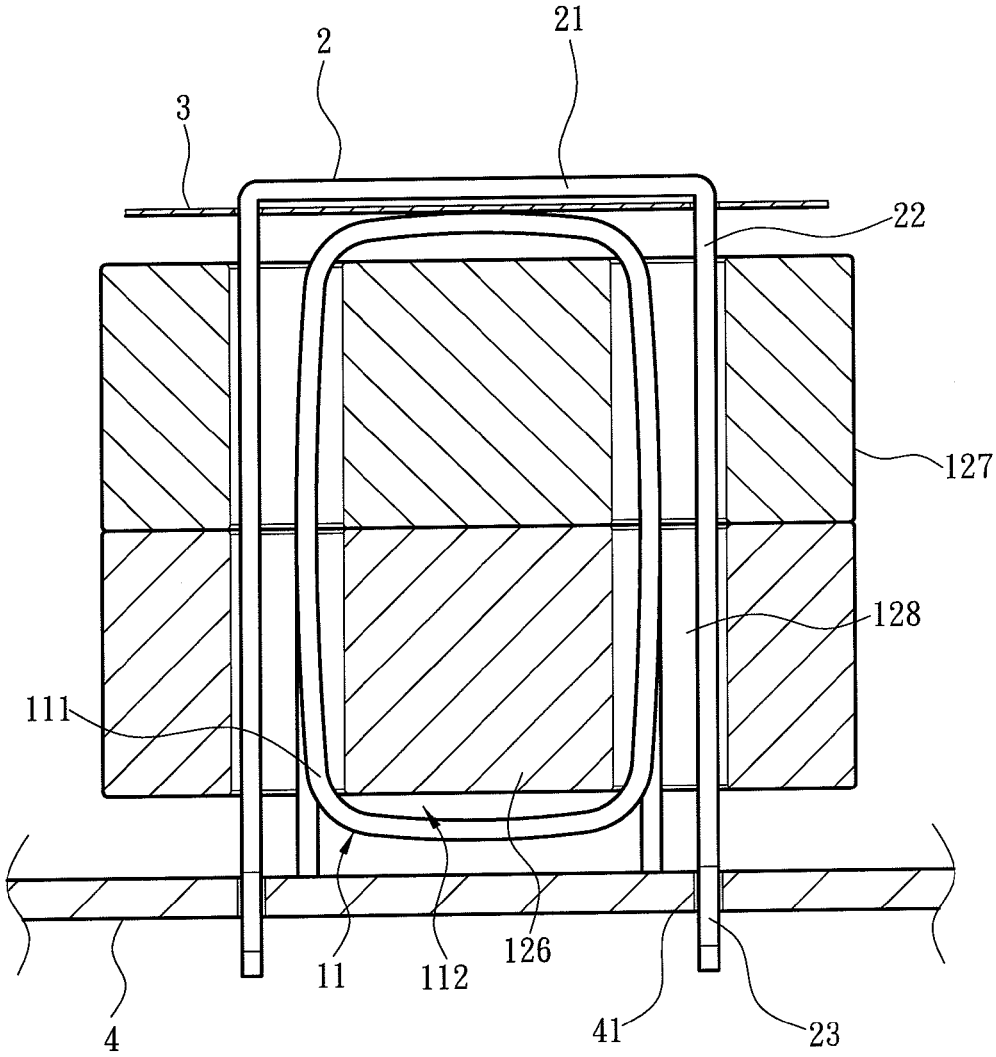
FIG. 3 is a cross section of the transformer without coil racks according to the invention.

Please refer to FIG. 3 for a cross section of the invention. In this embodiment, the coil portion 11 is mounted onto the circuit board 4, and the inner magnetic core portion 123 of the first magnetic core 121 and inner magnetic core portion 126 of the second magnetic core 122 run through the insertion passage 112 to couple with the coil portion 11 to form the winding set 1. The insulation mounting sheet 3 is located on the winding set 1, and the extended arms 22 of the conductive plates 2 run through the retaining slots 31 and gaps 125 and 128, such that the connection pins 23 are connected to the mounting slots 41 of the circuit board 4 to form a magnetic loop.

Figure 4:
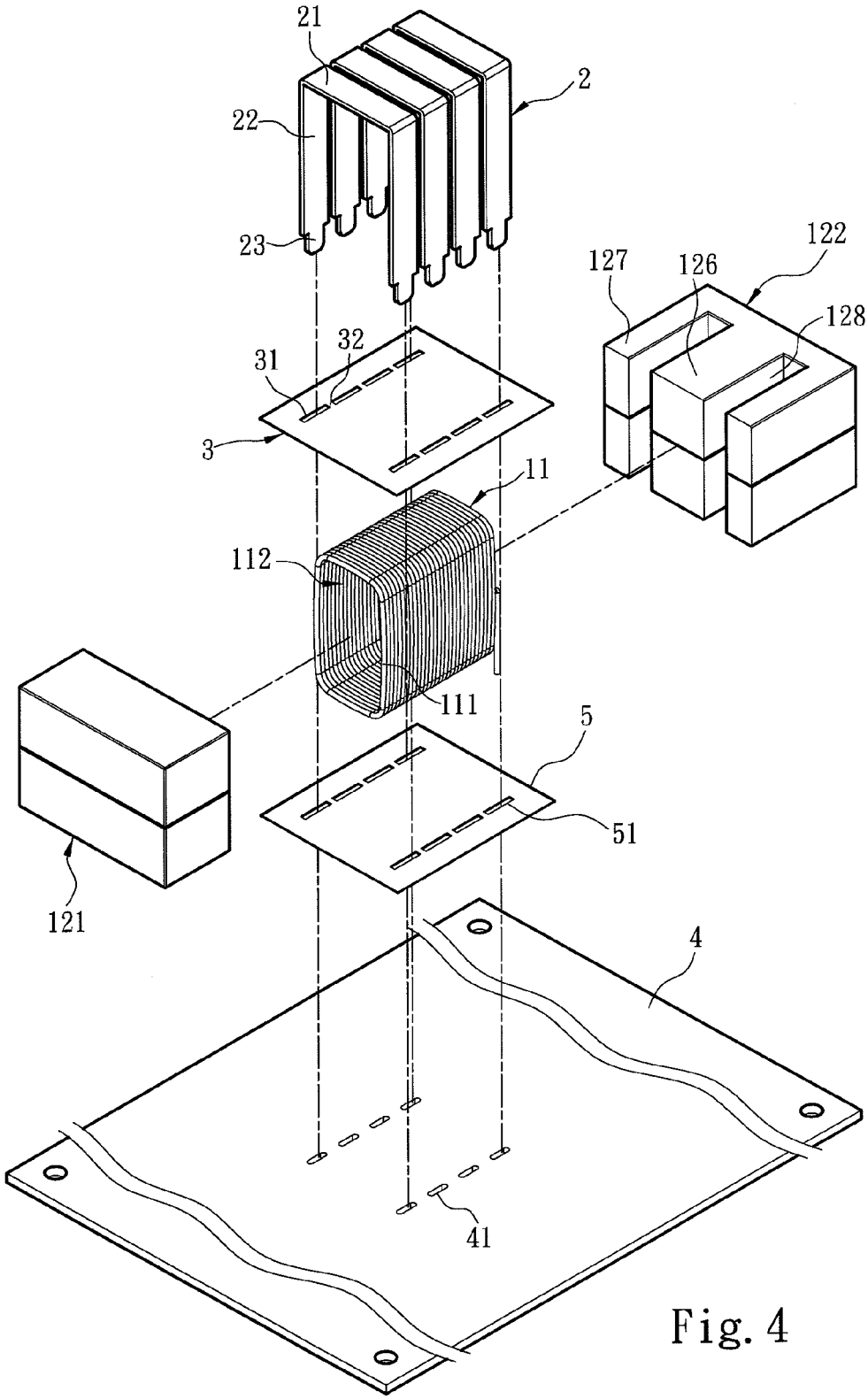
FIG. 4 is an exploded view of another embodiment of the transformer without coil racks according to the invention.

Please refer to FIG. 4 for another embodiment of the transformer of the invention in which the first magnetic core 121 and second magnetic core 122 form an IE combination. The first magnetic core 121 is an I type magnetic core, and the second magnetic core 122 is an E type magnetic core which has an inner magnetic core portion 126 and two outer magnetic core portions 127 at two sides of the inner magnetic core portion 126. The inner magnetic core portion 126 is spaced from the outer magnetic core portions 127 by a gap 128. The extended arms 22 run through the gap 128 to couple with the circuit board 4. In order to make the structure of the invention firmer, a reinforcing mounting sheet 5 is provided between the coil portion 11 and circuit board 4. The reinforcing mounting sheet 5 has a plurality of insertion slots 51 corresponding to the retaining slots 31, so that after the conductive plates 2 have passed through the gap 128, the extended arms 22 run through the insertion slots 51 and the connection pins 23 can be connected to the mounting slots 41 of the circuit board 4, thereby the extended arms 22 near the connecting section 21 can be confined by the insulation mounting sheet 3, while the portions thereof near the connection pins 23 are confined by the reinforcing mounting sheet 5, hence the entire structure of the invention becomes firmer.

As a conclusion, the invention is to couple the magnetic core set 12 and coil portion 11 together, and then allows a plurality of conductive plates 2 to run through the insulation mounting sheet 3 to straddle the coil portion 11 and also run through the gaps 125 and 128 to be mounted onto the circuit board 4. The retaining slots 31 and retaining portions 32 confine the conductive plates 2 from moving and contacting each other to prevent short circuit. The invention thus formed also can be firmly mounted onto the circuit board 4. In addition, the invention can further provide a reinforcing mounting sheet 5 with the insertion slots 51 formed thereon to confine the extended arms 22 that run through the gaps 125 and 128, thereby a stronger structure can be formed to hold the transformer on the circuit board 4 without the coil racks needed in the conventional transformers. As a result, the transformer of the invention can be made in a smaller size to conform to the prevailing trend of slim and light of miniaturization of electronic products. It provides significant improvements over the conventional techniques.

While the preferred embodiments of the invention have been set forth for the purpose of disclosure, they are not the limitations of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A transformer without coil racks mounted onto a circuit board, comprising:

a winding set including a coil portion which is located above the circuit board and includes a plurality of predetermined number of coils, and a magnetic core set running through the coil portion, the coil portion including a conductive wire with two ends electrically connected with the circuit board and an insertion passage formed by winding of the conductive wire to allow the magnetic core set to pass through; the magnetic core set including at least one inner magnetic core portion running through the insertion passage and at least two outer magnetic core portions at two sides of the inner magnetic core portion, the inner magnetic core portion being spaced from the two outer magnetic core portions by a gap;

a plurality of conductive plates straddling the coil portion, each of the plurality of conductive plates at least including a connecting section to cover a top side of the coil portion, two extended arms connected to two ends of the connecting section and running through the gap, and two connection pins extended from the two extended arms to connect to the circuit board; and an insulation mounting sheet which is interposed between the connecting section and the coil portion, and includes a plurality of retaining slots corresponding to the gap to allow the two extended arms to pass through and a plurality of retaining portions each being formed between two neighboring retaining slots to confine the extended arms from contacting each other, the conductive plates running through the plurality of retaining slots and being confined by the plurality of retaining portions from moving.

2. The transformer of claim 1, wherein the magnetic core set includes a first magnetic core and a second magnetic core opposing the first magnetic core, the first magnetic core formed at a coaxial length to run through the insertion passage being smaller than that of the second magnetic core to run through the insertion passage.

3. The transformer of claim 2, wherein the first magnetic core and the second magnetic core form an EE or EI combination.

4. The transformer of claim 1 further including a reinforcing mounting sheet which is located between the coil portion and the circuit board, and includes a plurality of insertion slots corresponding to the retaining slots.

5. The transformer of claim 1, wherein the circuit board includes a plurality of mounting slots corresponding to the connection pins.

* * * * *